US007077719B2

(12) United States Patent
Shiekman

(10) Patent No.: US 7,077,719 B2
(45) Date of Patent: Jul. 18, 2006

(54) BREAST SUPPORT APPARATUS

(76) Inventor: Suzanne A. Shiekman, 25 Samana Dr., Miami, FL (US) 33133

( * ) Notice: Subject to any disclaimer, the term of this patent is extended or adjusted under 35 U.S.C. 154(b) by 0 days.

(21) Appl. No.: 11/013,014

(22) Filed: Dec. 15, 2004

(65) Prior Publication Data

US 2005/0136795 A1 Jun. 23, 2005

Related U.S. Application Data

(60) Provisional application No. 60/531,025, filed on Dec. 19, 2003.

(51) Int. Cl.
*A41C 3/00* (2006.01)

(52) U.S. Cl. ..... 450/1; 450/58; 450/60

(58) Field of Classification Search ..... 450/1, 450/57, 58, 53, 60, 81, 80, 56; 128/888–894; 2/267, 73, 46, 463, 455, 311–312, 336, 338
See application file for complete search history.

(56) References Cited

U.S. PATENT DOCUMENTS 6,406,353 B1 * 6/2002 Harper ..... 450/57

* cited by examiner

*Primary Examiner*—Gloria M. Hale
(74) *Attorney, Agent, or Firm*—Ruden, McClosky; Stanley A. Kim

(57) ABSTRACT

A breast support apparatus for use in supporting and positioning surgically augmented breasts and methods of use have been developed. The breast support apparatus is worn around the circumference of the torso under augmented breasts of a user to give support to and properly position the augmented breasts in such a way so as to make the augmented breasts appear more natural, while maintaining the appearance that no bra support is being worn.

8 Claims, 4 Drawing Sheets

BREAST SUPPORT APPARATUS

CROSS REFERENCE TO RELATED APPLICATION

This application claims priority from U.S. Provisional Patent Application Ser. No. 60/531,025, filed Dec. 19, 2003, entitled BREAST SUPPORT STRAP.

TECHNICAL FIELD

The present invention generally relates to means for providing breast support. More specifically, the invention relates to a breast support apparatus used to support and position surgically augmented breasts and to prevent the downward shifting commonly associated with breast implants. The breast support apparatus of the present invention provides such support while maintaining the appearance that the woman is not wearing a bra.

When breasts are augmented through surgery, whether by placing an implant behind the muscle tissue of the chest or in front of the muscle tissue, for aesthetic reasons or for reconstructive purposes, such as for a procedure after a mastectomy, over time, the implant may begin to sag, and additionally, the augmented breasts may be somewhat more far apart than non-augmented breasts. The breasts may even be far enough apart that the person's arms may unintentionally and undesirably bump their breasts when lifted from their sides. Over time, due to the weight of the implants, the pocket into which the implant was placed begins to stretch, and the implants then shift or move downward. This downward shift can occur unevenly in either of the augmented breasts, or if only one breast was augmented, cause one breast to appear dramatically different than the non-augmented breast. Further, when the implant begins to shift downward, the nipples of each augmented breast tend to sit artificially high on the breast, making the augmented breast look increasingly artificial compared to a natural, non-augmented breast.

SUMMARY OF THE INVENTION

The present invention relates to a support apparatus worn around the circumference of the torso just under augmented breasts of a female user to give support to and properly position the augmented breasts in such a way so as to make the augmented breasts appear more natural, while maintaining the appearance that no bra support is being worn. This invention can also be used with natural, non-augmented breasts to provide similar benefits including forcing breasts upwards and inwards as well as pushing the breast together to reduce the separation between the breasts.

The support apparatus can be worn on an equal level around the torso, which reduces the exaggerated roundness of the implant. Additionally, the support apparatus may be worn higher in the back compared to the front of the torso, which forces the augmented breast upwards and inwards. The support apparatus helps to lift the sagging implant back into the position intended by the surgeon, thereby repositioning the nipple back to the center of the breast, resulting in a more natural appearance. The support apparatus also pushes the breasts together and upward, reducing the separation between the breasts.

By wearing the support apparatus, a woman may appear braless as there are no support straps worn around the shoulders. A woman regains the ability to wear clothes in a carefree way without the distortions of misshapen or sagging breasts, and may do so without the use of a heavy bra. The support apparatus does not overly restrict the movements of the individual wearing it, and reduces any fear of the sudden shifting of the implants as the pocket the implant was inserted into begins to loosen. The support apparatus provides these beneficial characteristics without the use of a bra cup or the shoulder-support straps which commonly limit the choice of clothing available for the woman to wear. In addition to the aesthetic purposes for which the support apparatus may be implemented, the support apparatus can reduce the sagging and heaviness of the implant, thereby reducing the stretching of the implant muscle pocket, the incision pocket and possibly preventing future corrective surgery to reduce the sagging and shifting of the implant.

Several different variations of a breast support apparatus are within the invention. In one embodiment, the apparatus is composed primarily of elastic. The support apparatus is worn tightly around the torso, under the breasts, and can be either secured by means of a fastener such as a hook, button, or the like, or the apparatus may simply be entirely elastic and positioned by stepping into it and sliding it on up onto the torso.

The breast support apparatus can include various fabrics for comfort, including terrycloth, and the use of clear material to ensure that the apparatus is not detectable when worn under clothing. The breast support fabric can be any suitable color or combination of colors.

A breast support apparatus of the invention can include a non-slip material, such as the rubber material found in bathing suits. Any suitable non-slip material, however, may be used. The non-slip material may be present as a liner or present as strips on the inside of the apparatus that is in contact with the body.

A breast support apparatus of the invention can include sections which conform to the roundness of the underside of the breast, thereby improving comfort and fit.

Accordingly, the invention features a breast lobe support apparatus including a belt circumventing a torso, positioned subordinate to at least one breast lobe on a chest wall and positioned adjacent to the inframammary crease of said breast lobe; whereby the median transverse plane of said breast lobe is elevated and the median sagittal plane of said breast lobe is moved toward the midsagittal plane of said torso.

In another aspect, the invention features an apparatus for supporting an artificial breast on a person, the apparatus including a torso-encircling band having an interior portion that contacts the torso and an exterior portion that in at least one place, contacts a breast, the interior portion of the band including non-slip material co-operable with the torso-encircling band. The torso-encircling band can be elastic. The torso-encircling band can further include a piece of fabric co-operable with the torso-encircling band, the fabric being positioned between the torso-encircling band and skin of the person. The torso-encircling band can be a continuous piece of material. The torso-encircling band can also be a piece of material having two ends. The band can further include a fastening means for fastening the two ends of the band together and can be adjustable.

Within the invention is a method of supporting an artificial breast on a person. This method includes the steps of: (a) providing an apparatus including a torso-encircling band having an interior portion that contacts the torso and an exterior portion that in at least one place, contacts a breast, the interior portion of the band including non-slip material co-operable with the torso-encircling band; and (b) positioning the apparatus on the person.

In still another aspect, the invention features a kit for supporting an artificial breast on a person. This kit includes: (a) an apparatus including a torso-encircling band having an interior portion that contacts the torso and an exterior portion that in at least one place, contacts a breast, the interior portion of the band including non-slip material co-operable with the torso-encircling band; and (b) instructions for use of the apparatus.

As used herein, a "breast lobe" is defined as the part of the breast that protrudes away from the chest wall.

As used herein, an "inframammary crease" is the crease under the breast where the breast lobe meets the chest wall.

Although methods and materials similar or equivalent to those described herein can be used in the practice or testing of the present invention, suitable methods and materials are described below. The particular embodiments discussed below are illustrative only and not intended to be limiting.

DETAILED DESCRIPTION OF THE PREFERRED EMBODIMENT

Referring to FIGS. 1–4, the coordinate system assumes a human standing, with arms hanging down and palms to the front. The median transverse plane of a breast lobe is located at the midpoint of a breast lobe and is a plane that is parallel to the ground. The median sagittal plane of a breast lobe is located at the midpoint of the breast lobe, is perpendicular to the ground, and separates the breast lobe into left and right halves. The midsagittal plane of the torso separates the human body into left and right halves.

Figure 2:
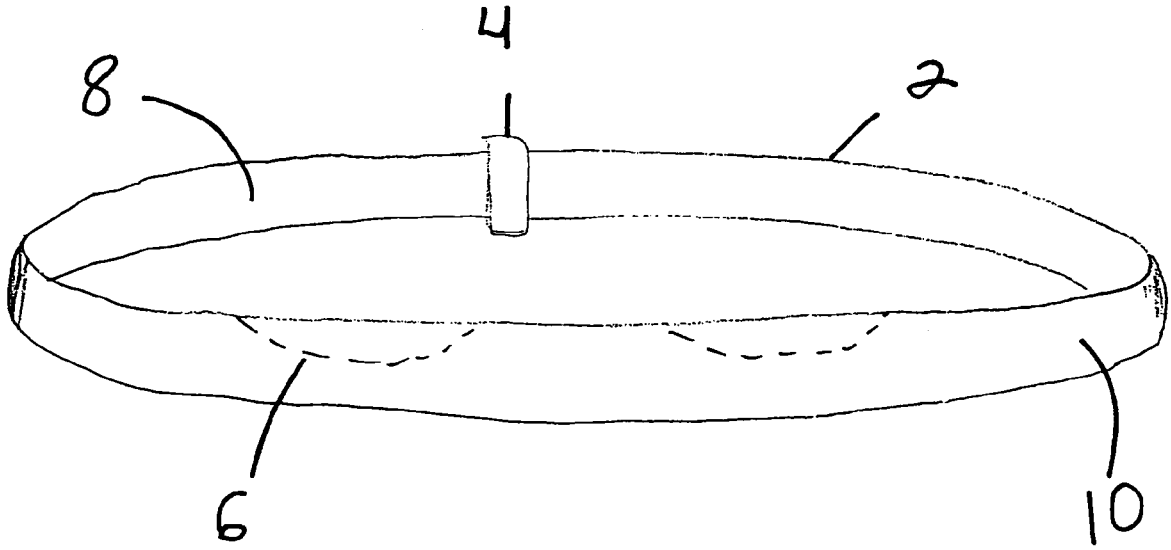
FIG. 2 shows a support apparatus of the present invention.
Figure 3:
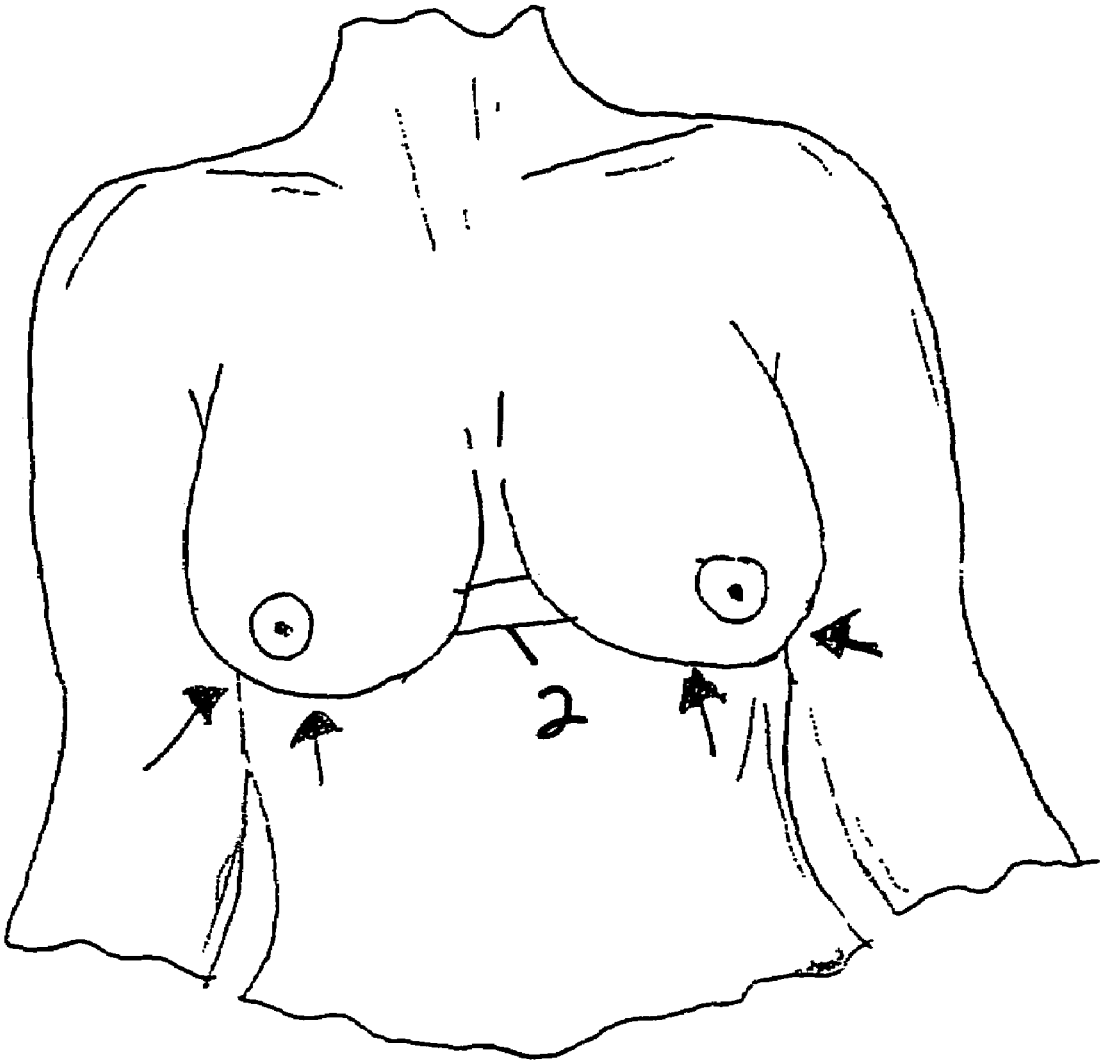
FIG. 3 shows a frontal view of a woman wearing a support apparatus of the present invention.
Figure 4:
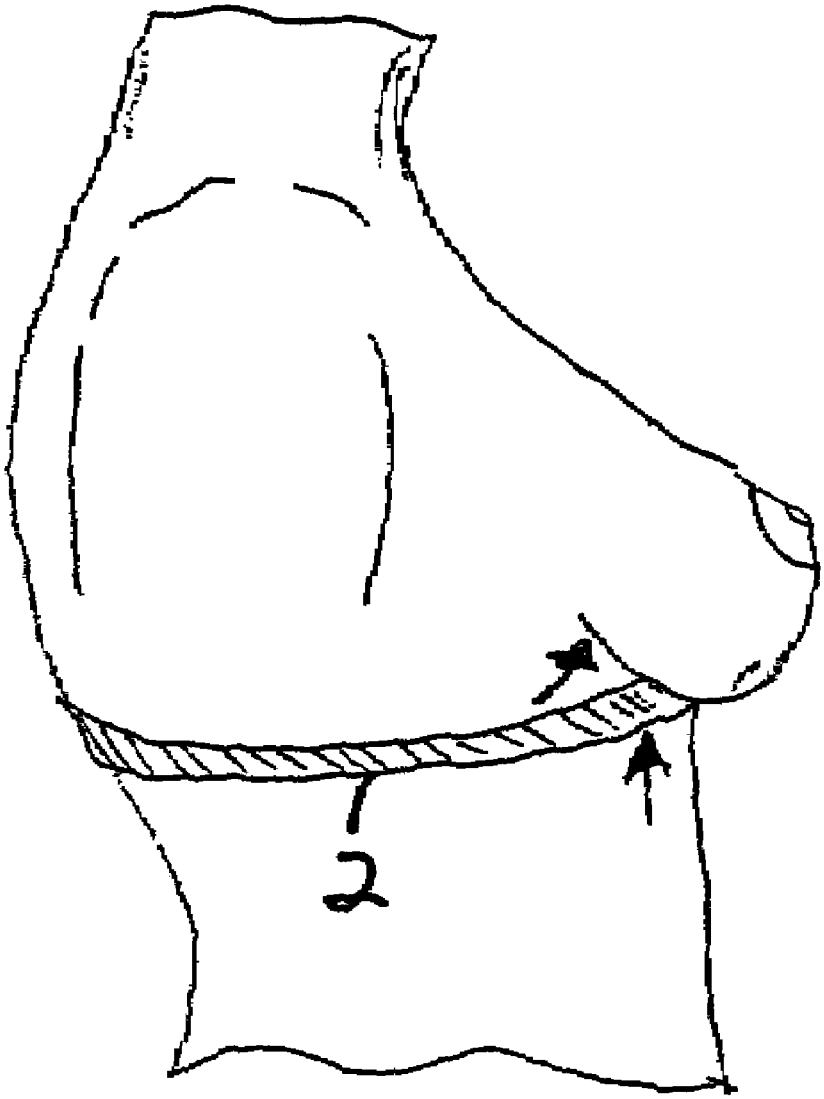
FIG. 4 shows a side view of a woman wearing a support apparatus of the present invention.

The present invention includes a breast support apparatus 2 for use in supporting and positioning surgically augmented breasts, shown in FIG. 2. Breast support apparatus 2 can be made out of any material or combination of materials, such as elastic, fabric, or the like, and is worn by a female with augmented breasts around the circumference of her torso, as shown in FIGS. 3 and 4. The breast support apparatus 2 may be a continuous ring of elastic, fabric, or the like, and worn by a woman by first stepping into breast support apparatus 2 and then sliding breast support apparatus 2 along the body and onto the torso. In another embodiment, the breast support apparatus 2 may have two ends that are connected by a fastening mechanism 4, such as a hook, clasp, button, or the like, used to secure support apparatus 2 into place around the torso. Mechanism 4 could also include one or more links which can be removed for adjusting the circumferential length of the apparatus 2.

Breast support apparatus 2 may include a non-slip material, such as the rubber material found in bathing suits. Any suitable non-slip material, however, may be used. The non-slip material may be present as a liner or present as strips on the interior portion 8 of the breast support apparatus 2 that is in contact with the body. The non-slip material may also be present on the exterior portion 10 of the breast support apparatus 2 that in at least one place, contacts a breast.

Figure 1:
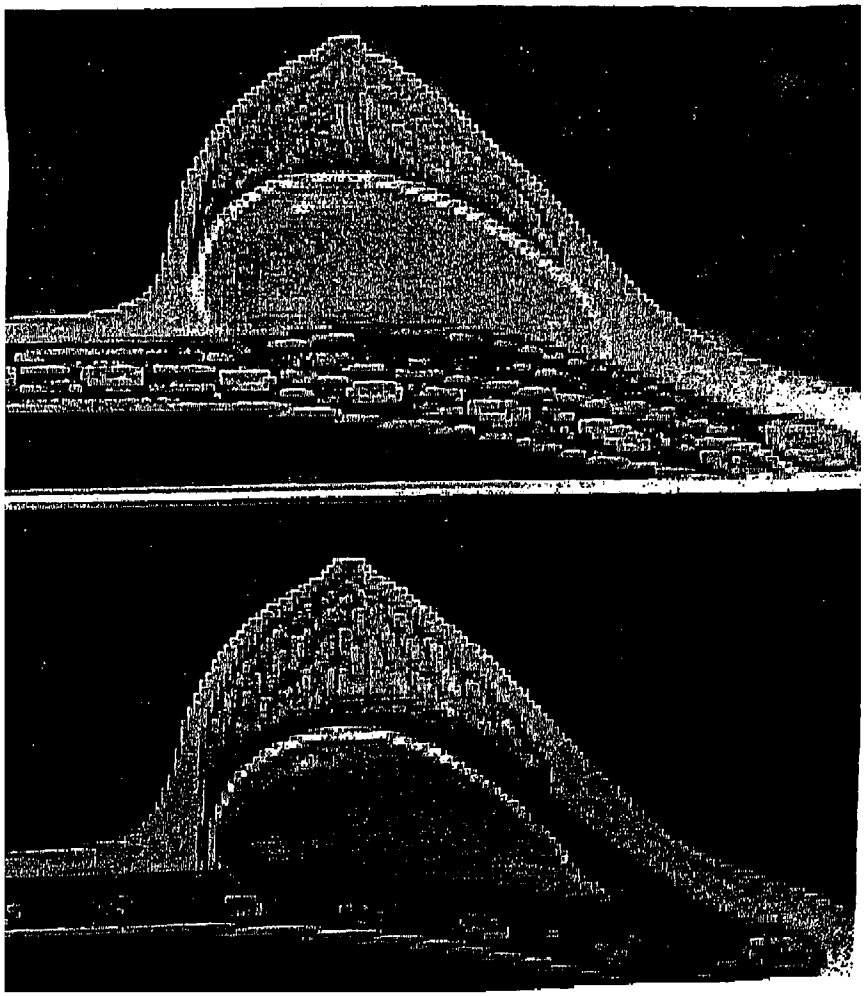
FIG. 1 shows the implant position both in front of and behind the chest muscle.

The breast support apparatus 2 may further include a breast conforming feature 6, which could be in the form of circular indentations or cut-outs, allowing for improved fit and comfort, as shown in FIG. 2. Breast support apparatus 2 is worn directly under the augmented breasts, thereby providing support for the implant, which forces the implant upward and inward, as shown by the directional arrows in FIGS. 3 and 4. Because breast support apparatus 2 has neither additional shoulder straps nor breast cups, a woman may wear breast support apparatus 2 while maintaining a look of being braless. Breast support apparatus 2 is equally effective in supporting and positioning augmented breast whether the implant is placed beneath the muscle tissue of the chest, or in front of the muscle tissue of the chest, as shown in FIG. 1.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A method of supporting an artificial breast on a person, the method comprising the steps of:

(a) providing an apparatus consisting essentially of a torso-encircling band having an exterior portion comprising at least one section for contacting the breast, and an interior portion for contacting the torso, the interior portion of the band comprising non-slip material for preventing the band from slipping; and (b) positioning the apparatus on the person such that the band encircles the torso beneath the breast and higher on the back of the torso than on the front of the torso to force the breast upwards and inwards.

2. The method of claim 1, wherein the tone-encircling band is elastic.

3. The method of claim 1, wherein the apparatus further consists essentially of a piece of fabric co-operable with the torso-encircling band, wherein the fabric is positioned between the torso-encircling band and skin of the person.

4. The method of claim 1, wherein the torso-encircling band is a continuous piece of material.

5. The method of claim 1, wherein the torso-encircling band is a piece of material having two ends.

6. The method of claim 5, wherein the apparatus further consists essentially of a fastening means for fastening the two ends of the band together.

7. The method of claim 1, wherein the torso-encircling band is adjustable.

8. A kit for supporting an artificial breast on a person, the kit comprising:

(a) an apparatus consisting essentially of a torso-encircling band having an exterior portion comprising at least one section for contact the breast, and an interior portion for contacting the torso, the interior portion of the band comprising non-slip material for preventing the band from slipping; and (b) instructions for positioning the apparatus beneath the breast and higher on the back of the torso than on the front of the torso to force the breast upwards and inwards.

* * * * *